US007422519B2

(12) United States Patent
Brown

(10) Patent No.: US 7,422,519 B2
(45) Date of Patent: Sep. 9, 2008

(54) CHIMNEY DAMPER

(76) Inventor: Lawrence A. Brown, 798 E. Brown Rd., Pekin, IN (US) 47165

( * ) Notice: Subject to any disclaimer, the term of this patent is extended or adjusted under 35 U.S.C. 154(b) by 0 days.

(21) Appl. No.: 11/080,355

(22) Filed: Feb. 17, 2005

(65) Prior Publication Data

US 2005/0250433 A1 Nov. 10, 2005

Related U.S. Application Data

(63) Continuation-in-part of application No. 10/927,783, filed on Aug. 27, 2004, now abandoned.

(60) Provisional application No. 60/545,769, filed on Feb. 18, 2004, provisional application No. 60/545,342, filed on Feb. 17, 2004, provisional application No. 60/498,672, filed on Aug. 28, 2003, provisional application No. 60/498,350, filed on Aug. 27, 2003.

(51) Int. Cl.
*F23J 13/08* (2006.01)

(52) U.S. Cl. ..... 454/4

(58) Field of Classification Search ..... 454/4
See application file for complete search history.

(56) References Cited

U.S. PATENT DOCUMENTS

| | | | |
|---|---|---|---|
| 1,720,789 | A | 7/1929 | Heusser |
| 2,242,738 | A | 5/1941 | Alton |
| 2,313,350 | A | 3/1943 | Lebus |
| 2,856,839 | A | 10/1958 | Soderberg |
| 3,101,039 | A | 8/1963 | Duchene et al. |
| 3,267,832 | A | 8/1966 | Hinkle |
| 3,377,939 | A | 4/1968 | Sailors |
| 3,730,112 | A | 5/1973 | Hutchinson et al. |
| 3,945,307 | A | 3/1976 | Lyemance |
| 4,007,730 | A | 2/1977 | Heebink |
| 4,020,754 | A | 5/1977 | Dalsin et al. |
| 4,165,679 | A | 8/1979 | Lyemance |
| 4,181,119 | A | 1/1980 | Lyles |
| 4,256,257 | A | 3/1981 | Pinkerton |
| 4,368,663 | A | 1/1983 | Tabacco |
| 4,481,933 | A | 11/1984 | Sawtelle |
| 4,528,897 | A | 7/1985 | Homolik |
| 4,554,863 | A | 11/1985 | Dalsin |
| 5,080,006 | A | 1/1992 | Von Sick |
| 5,125,869 | A | 6/1992 | VonSick |

(Continued)

*Primary Examiner*—Steve McAllister
*Assistant Examiner*—Helena Kosanovic
(74) *Attorney, Agent, or Firm*—David W. Carrithers; Carrithers Law Office PLLC

(57) ABSTRACT

A chimney damper that includes a rigid first peripheral frame surrounding an open window area, a cap moveable toward and away from the open window to selectively close and open the same and springs interconnecting the cap and frame resiliently urging the cap to an open position. The springs are connected at the upper ends thereof to second rigid frame. The cap is mounted on the second frame and the latter is allowed to pivot relative to the cap. The springs and the arrangement thereof are such as to cause the second frame to rotate relative to the first frame during opening and closing of the damper with the rotation being about one quarter turn. An articulated link interconnects the first frame and coupling between the second frame and the cap so as to prevent pivoting of the cap when moving the cap from one to the other of an open and a closed position.

20 Claims, 6 Drawing Sheets

U.S. PATENT DOCUMENTS

| | | | | |
|---|---|---|---|---|
| 5,163,516 | A | | 11/1992 | Palmatier |
| 5,193,622 | A | | 3/1993 | Tibbling |
| 5,247,998 | A | | 9/1993 | Fallon |
| 5,295,901 | A | | 3/1994 | Sexton |
| 5,437,574 | A | | 8/1995 | Sexton |
| 5,556,329 | A | * | 9/1996 | VonSick ..... 454/4 |
| 5,848,931 | A | * | 12/1998 | Dortzbach ..... 454/4 |
| 5,857,904 | A | | 1/1999 | Van Horn |

* cited by examiner

CHIMNEY DAMPER

This application is a Continuation in Part application claiming priority from: U.S. application Ser. No. 10/927,783 which was filed on Aug. 27, 2004 claiming priority from U.S. Provisional Application Ser. No. 60/498,350 filed on Aug. 27, 2003 and Provisional application Ser. No. 60/498,672 filed on Aug. 28, 2003; U.S. Provisional Application Ser. No. 60/545,342 filed on Feb. 17, 2004; and Provisional Application Ser. No. 60/545,769 filed on Feb. 18, 2004 all of which are incorporated herein in their entirety.

FIELD OF THE INVENTION

This invention relates generally to a spring biased chimney damper and more particularly to an improved interconnection of the cap and spring biasing means.

BACKGROUND OF THE INVENTION

The prior art shows various type of dampers with and without spring means to hold the cap away from the frame in or on the chimney flue when not in use. For instance, U.S. Pat. No. 5,125,869 granted on Jun. 30, 1992, and U.S. Pat. No. 5,556,329 granted on Sep. 17, 1996 disclose a conventional spring biased chimney damper.

Typically, these prior art devices include a frame defining an open window area, a cap for selectively covering and uncovering the open window area, and spring means inter connecting the cap and frame and biasing the cap to it's open position. The springs are multi-component and connected to the frame outside of the window area. There may be a poorly designed alignment means to align the cap over the window opening as it is operative only the final phase of it's movement to the closed position. No means is provided for selectively adjusting the spacing between the cap and the frame in the cap open position.

Some chimney dampers include a lock mechanism to keep the damper in an open position in case of a chimney fire comprising a fusible link connected to spring means and in case of over heating, due to for example a chimney fire, the link melts causing the spring to move into a position in which it locks the cap in an open position. This fusible link must be replaced after each occurrence of overheating and because of the in use position of the damper on top of the chimney it is difficult to replace.

Moreover, some chimney damper embodiments require that the cap turn a quarter turn during each of the closing and opening movements. In another embodiment, the cap does not rotate and is captive in an outer skeleton frame limiting movement of the cap to reciprocal movement only wherein the spring system is connected to a plate that can move reciprocally on a shaft as well as rotate on that shaft.

SUMMARY OF INVENTION

The chimney damper disclosed in the present invention includes a first rigid peripheral frame surrounding an open window area corresponding generally to that of an end of the flue. A cap is included for covering the open window area. A second frame is interposed between the cap and the first frame. Spring means interconnecting the first and second frames causes the second frame to rotate relative to the first frame during opening and closing of the damper. The spring means biases the cap in a direction away from the first frame to a window open position. The cap is movable toward the first frame against a spring bias to overlie and thereby close the open window area. Means pivotally interconnecting the cap and the second frame are included together with means preventing rotation of the cap relative to the first frame when the cap is moved toward and away from the first frame during respectively closing and opening of the damper.

An object of the present invention is to provide an improved means that prevents rotation of the cap while the cap is being moved from one to the other of an open and closed position.

A further object of the present invention is to provide a means as described above while at the same time avoiding the use of an external frame for guiding the cap during it's movement toward an open and closed position.

Another object of the present invention is to provide an improved means for maintaining alignment of the cap outer downwardly directed peripheral flange with the upwardly directed outer peripheral flange on the chimney flue mounting flange.

More particularly, the chimney damper of the present invention includes a rigid first peripheral frame surrounding an open window area, a cap moveable toward and away from the open window to selectively close and open the same and springs interconnecting the cap and frame resiliently urging the cap to an open position. The springs are connected at the upper ends thereof to second rigid frame. The cap is mounted on the second frame and the latter is allowed to pivot relative to the cap. The springs and the arrangement thereof are such as to cause the second frame to rotate relative to the first frame during opening and closing of the damper with the rotation being about one quarter turn. An articulated link interconnects the first frame and coupling between the second frame and the cap so as to prevent pivoting of the cap when moving the cap from one to the other of an open and a closed position.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 1:
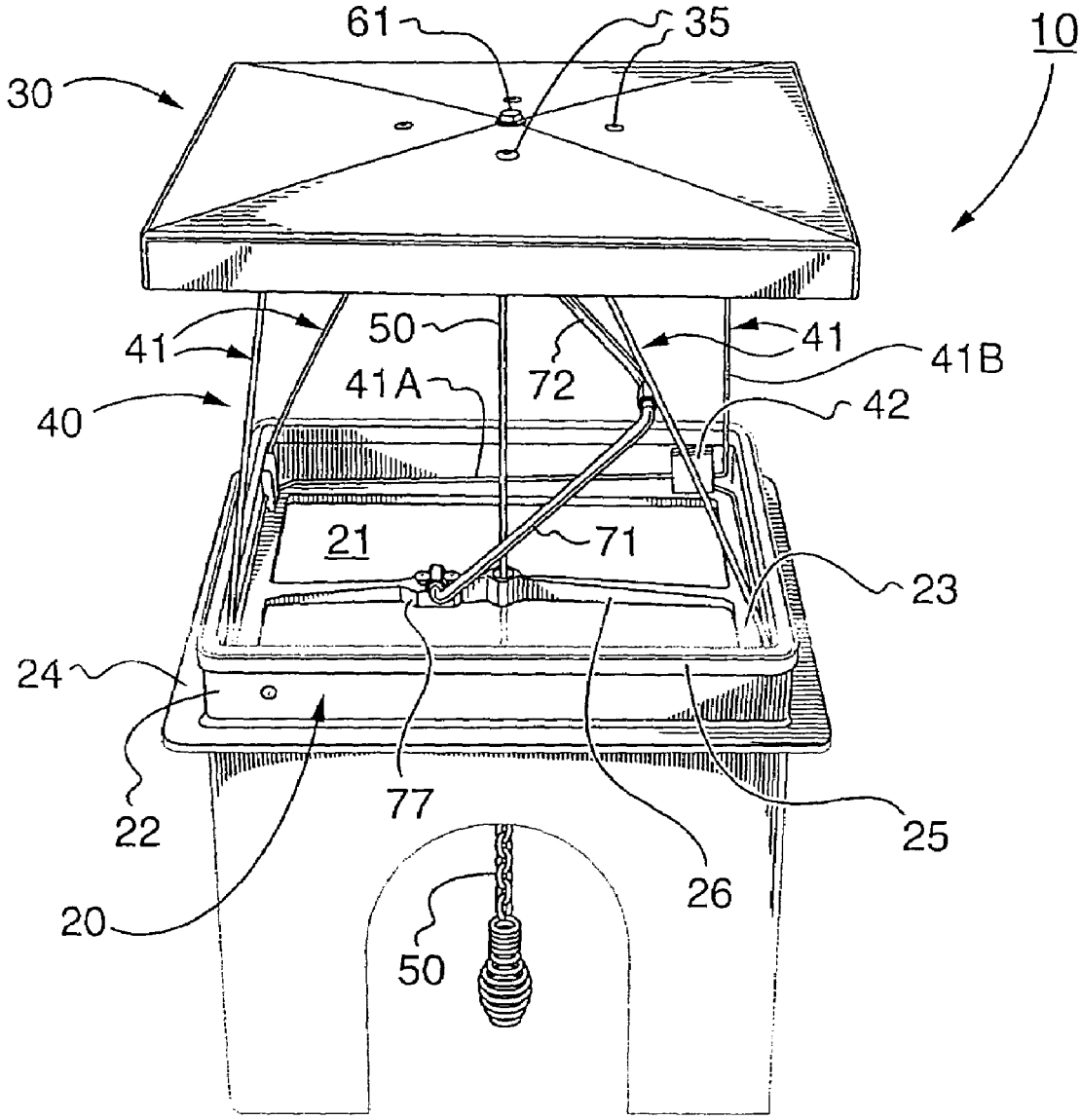
FIG. 1 is a top side perspective view of the chimney damper of the present invention in an open position portioned upon a chimney.
Figure 2:
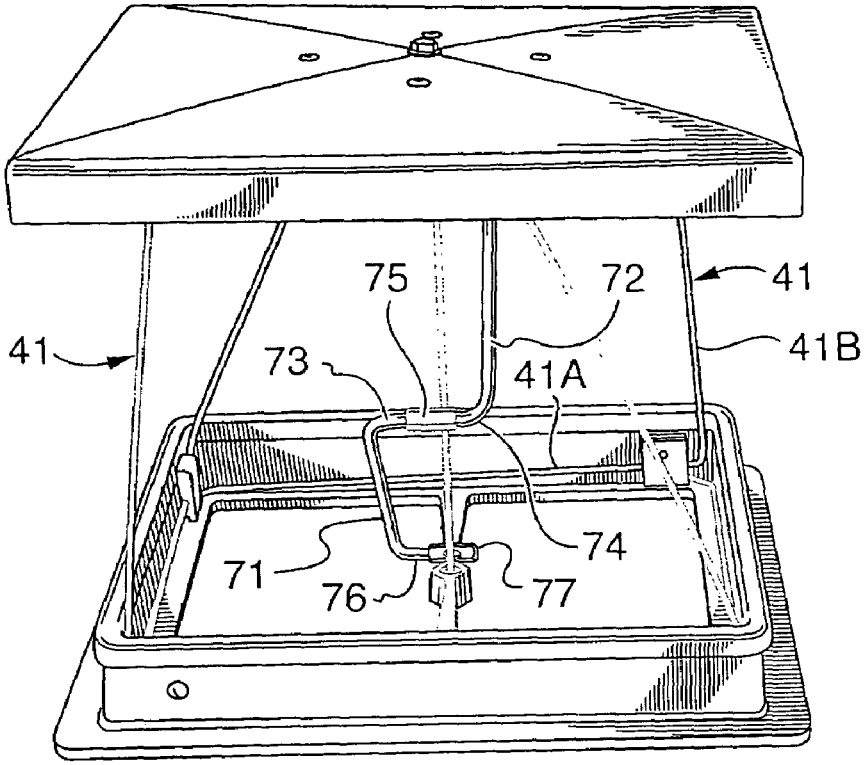
FIG. 2 is a right side perspective view of the chimney damper of FIG. 1.
Figure 3:
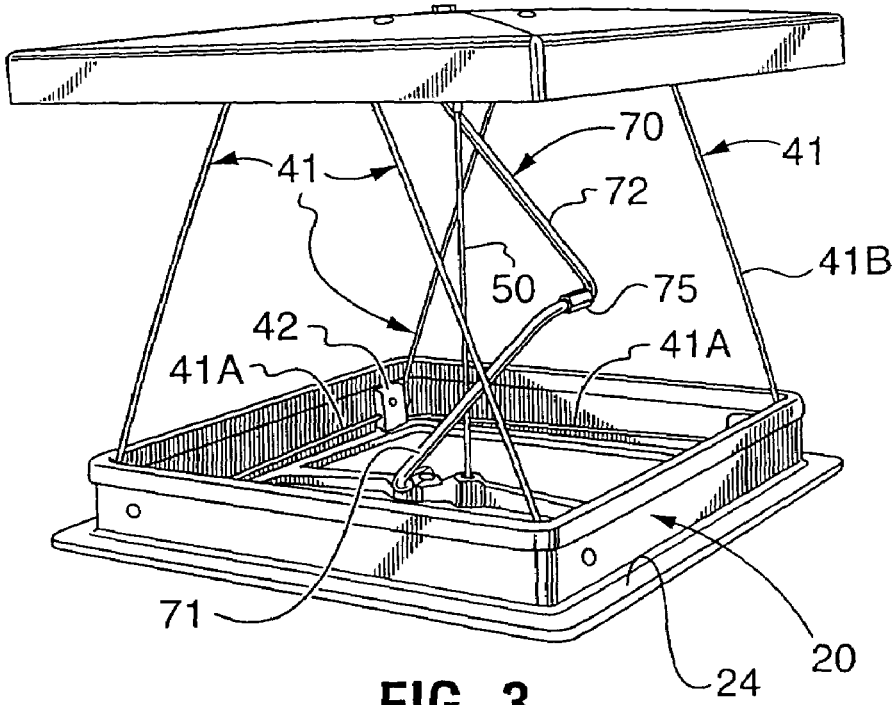
FIG. 3 is a perspective view of the chimney damper of FIG. 1 taken from a different angle to more clearly illustrate a portion of the cap rotation preventing means.
Figure 4:
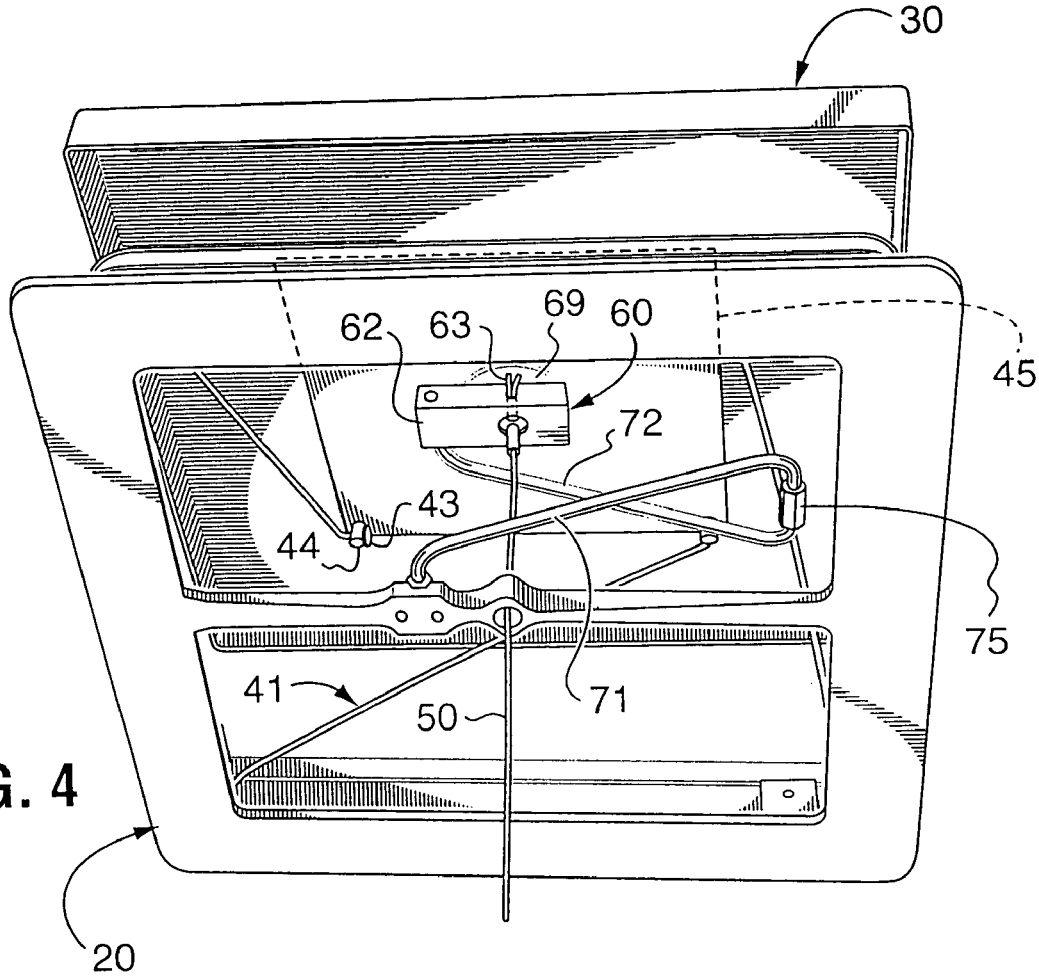
FIG. 4 is a bottom side perspective view of the chimney damper of FIG. 1 illustrating the cap in a partially closed position.
Figure 5:
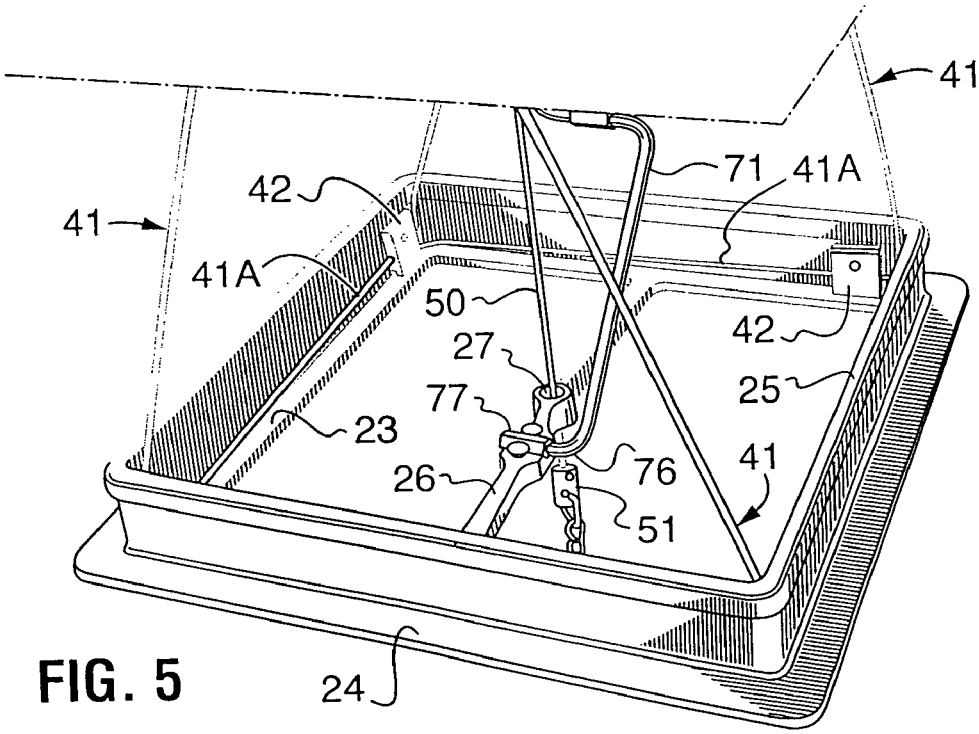
FIG. 5 is a perspective view of the chimney damper of FIG. 1 showing the upper inside portion of the bottom flue mounting open peripheral frame.
Figure 6:
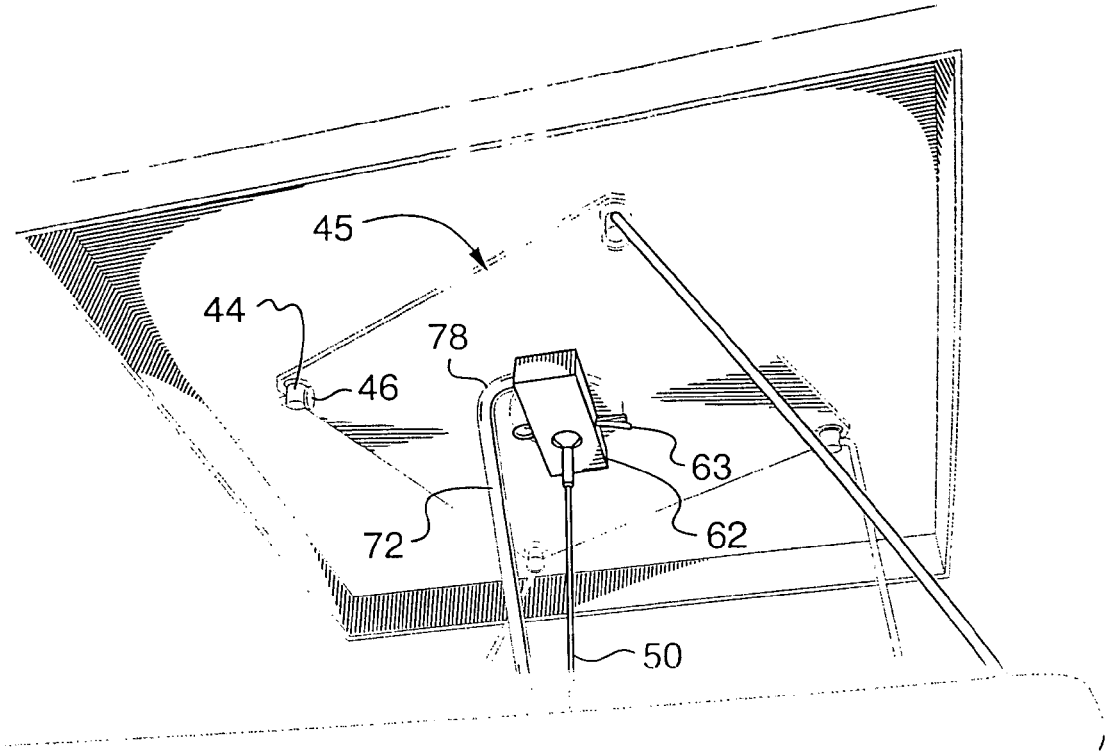
FIG. 6 is a perspective view showing a portion of the chimney damper looking up under the cap and upper frame member of the spring means on which the cap is mounted.

Illustrated in FIGS. 1-10 is a chimney damper 10 comprising a first peripheral frame 20 having an open window area 21 that is selectively opened and closed by moving a cap 30 respectively away from and toward the frame 20. The cap is connected to the frame by spring means 40 biasing the cap to it's open position. The cap is pulled to a closed position by a pull chain 50 against the force of the spring bias.

Figure 8:
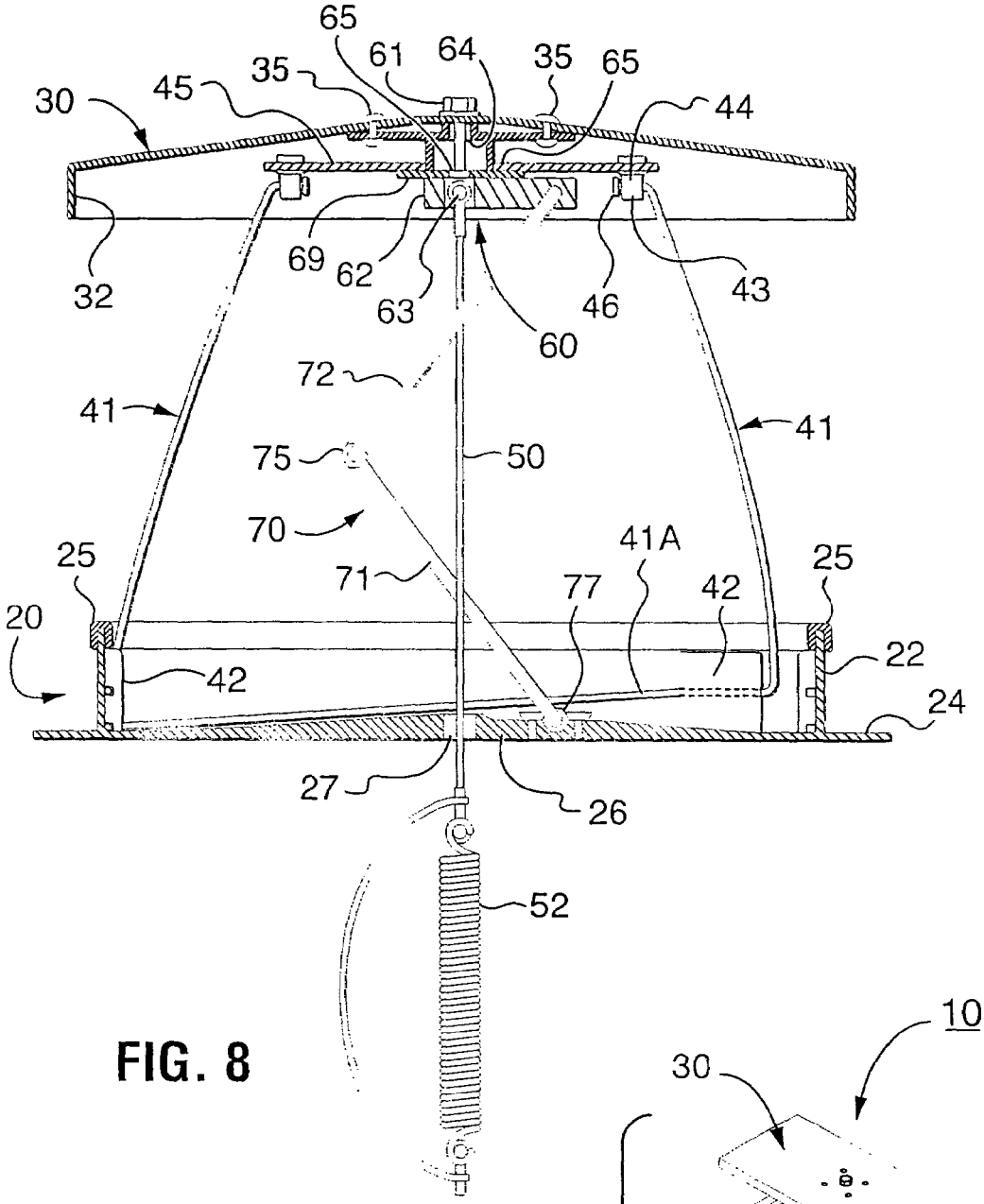
FIG. 8 is a vertical sectional view taken essentially along line 8-8 of FIG. 1.

The peripheral frame 20 illustrated is 'T'-shape in cross section having an upwardly directed flange 22 surrounding the open window area 21, a bottom flange portion 23 directed inwardly from the flange 22 and a portion 24 directed outwardly therefrom. A seal means 25 is located on the upper edge of the flange 22. A crossbar 26 traverses the open window and has the opposite ends thereof fixedly secured to the inwardly directed flange portion 23. The cross bar 26 has a through hole 27 though which the pull chain 50 (cable or cord) passes. An enlargement 51 on the pull chain can, if desired, be adjusted longitudinally along the chain 50 to abut against the crossbar 26 and thereby determine the maximum distance the cap 30 can move in a direction away from the first frame 20. As seen in FIG. 8 there is a partial loop in the pull chain caused by a tension spring 52 that is connected at opposite ends thereof in series with the pull chain 50.

The cap member 30 is rectangular and has a downwardly directed peripheral flange 32 that fits over and circumscribes the upwardly directed flange 22 on the frame member 20. Each spring member 41 has a leg portion 41A that extends beyond the clip 42 and along the frame flange 23. The leg portion 41A is a torsional spring member and a free end thereof spaced from the clip 42 is securely anchored to the flange. The seal mean 25 for example maybe a 'U"-shape rubber, or the like gasket member that fits onto the upper edge of the flange. It provides sealing contact with the under face of the cap when the latter is in it's closed position covering the open window of the frame. Obviously the gasket could be made of suitable material such as graphite, silicon, soft metal, or synthetic polymer materials to withstand heat that would be encountered even when a chimney fire occurs.

Figure 7:
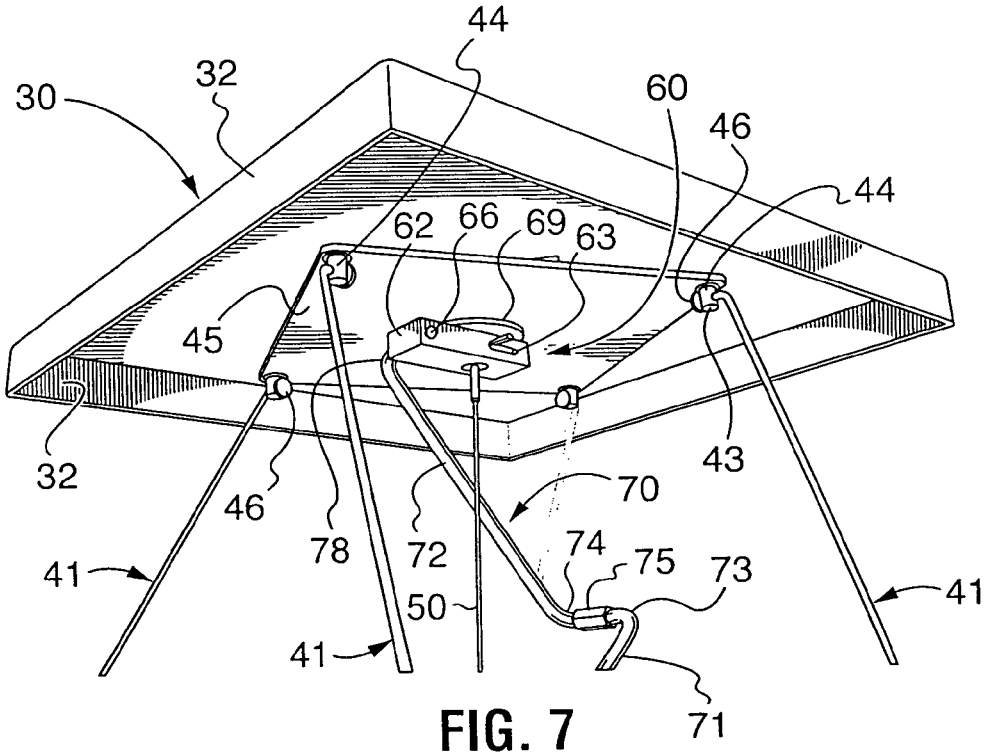
FIG. 7 is a perspective view showing a portion of the chimney damper looking up under the cap and upper frame member of the spring means on which the cap is mounted from a different angle than of FIG. 6.

The spring means 40 comprises four equal spaced wire springs 41 each having one of the opposite ends thereof fitting into an elongate sleeve 42 secured to an inside corner of the peripheral frame 20 and a stub leg 43 at the other end that projects into and passes though a hole in a pivot and swivel coupling member 44. The coupling member 44 is pivotally connected to a plate 45 the latter of which as will be more fully apparent hereinafter constitutes a second frame member. The couplings 44 are located adjacent respective ones of the four corners of the square plate 45. Means for holding such as a 'C'-clip 46 (or pressed on tight fit washer or the like) on the outer end of the leg 43 such as is illustrated in FIG. 7, keeps the leg and coupling inter-connected. The pivot and swivel coupling means 44 can comprise a post having an end portion of reduced size that projects through an aperture in the plate 45. An enlargement at the end such as a cap nut or the like retains the post on the cap member and a loose connection allows the post to oscillate during opening and closing of the damper. The other end of the post has the previously described through hole transverse to the axis of the post or alternatively a slot into which the end of the spring can project and loop around a pin as described in applicants above referred to pending application.

The wire springs bend and lie between the cap 30 and frame 20 when the damper is in it's closed state. To accomplish this it is necessary for the plate 45 to rotate a partial turn, (approximately one quarter turn), relative to the frame. The cap is mounted on the plate 45 by a coupling means 60 but is prevented from rotating with the plate because of a rotation preventing link 70 connected at one end thereof to the frame 20 and at the other end to the coupling means 60.

The coupling 60 includes a pin 61 that passes through a central hole in the cap 30 and projects downwardly therefrom through a through hole in the center of the plate 45. The pin is secured to the cap in any convenient manner as for example by a lock nut on the underside of the cap. It is contemplated a rivet could also be used therefor. An insert or spacer 64 is interposed between the lower surface of the cap and the adjacent upper surface of the plate 45. The insert is fixed to the cap 30 by rivets 35 and a washer 65 is inserted between the insert 64 and the plate 45. A block 62 is fixedly attached to a portion of the post that projects beyond the lower face of the plate as for example by a split pin or cotter pin 63 and a wear or friction reducing washer 69 is interposed between the plate's lower face and the block 62. The plate 45 pivots freely on the pin 61 but the block 62 is prevented from rotating with the plate by the cap rotation preventing means 70.

The cap rotation preventing means 70 is an articulated link connected at one end thereof to the frame 20 and at the other end to the block 62. Since both the cap 30 and the block are fixed to the pin 61, preventing the block from rotating also prevents the cap from rotating relative to the first frame 20 during opening and closing of the damper. The cap downwardly directed peripheral flange thus always remains aligned with the upwardly directed flange 22 of frame 20 to telescopically receive therein the upwardly directed flange.

The articulated link 70 comprises first and second respective elongate link members 71, 72 having respective end portions 73, 74 disposed transversely to the length of the respective members. The end portions 73 and 74 are directed inwardly toward one another in axial alignment and are interconnected by a member 75 allowing the end portions to pivot relative to one another about such axis. The first link member 71 has at the other end thereof an end portion 76 disposed parallel to the end portion 73 and projecting into a pillow block bearing 77 on the crossbar 26 that is attached to the frame 20. The link member 72 likewise has an end portion 78 disposed parallel to the end portion 74 and it projects into an aperture 66 in the block 62. The pull chain 50 is connected to the pin 61.

Figure 9:
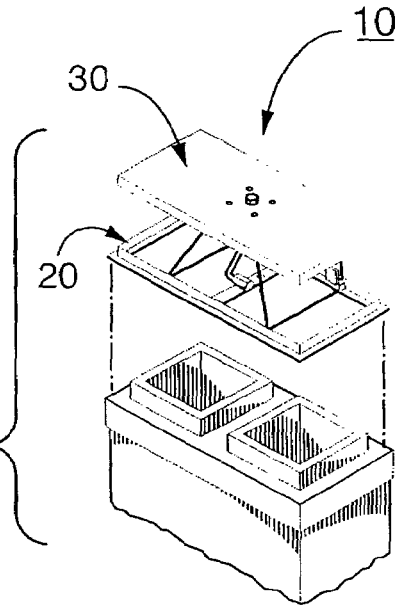
FIG. 9 is a perspective view of an alternate embodiment of the present invention utilizing the same pivoting mechanism as the devices shown in FIGS. 1-8; however, the frame and cap are rectangular to permit close spacing of a plurality of chimney dampers side by side.
Figure 10:
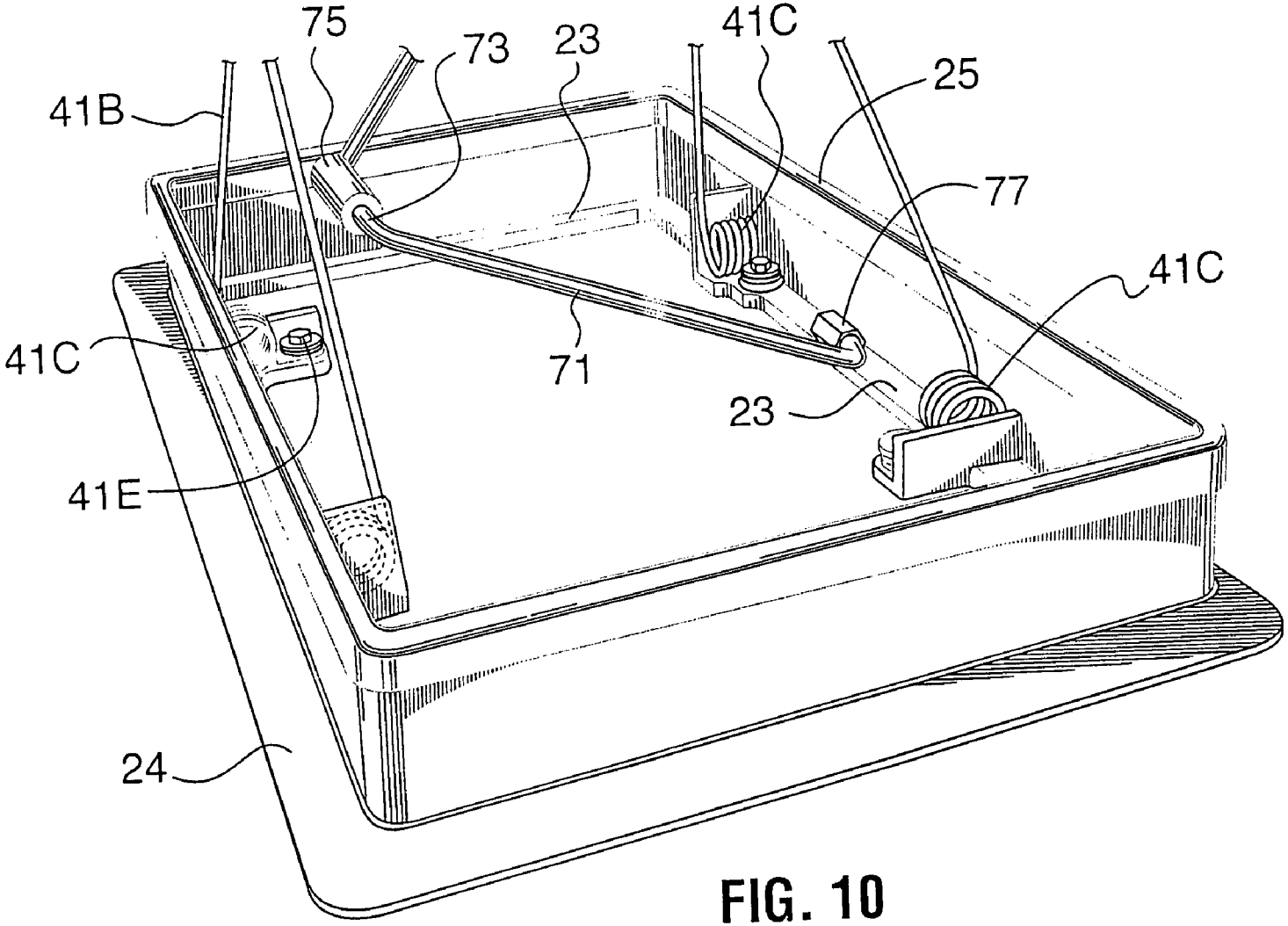
FIG. 10 is a perspective view of the embodiment of FIG. 9 showing the coiled portions of the spring for biasing and rotating the cap, whereby the mechanism is also applicable to the embodiment shown in FIGS. 1-8.

As shown in FIGS. 9 and 10, the biasing mechanism of the chimney damper 10 of the present invention can be modified to provide an embodiment suitable for use with rectangular chimney openings. Moreover, the device can be modified for use with hexagonal, octagonal or other unusually shaped chimney openings or multiple adjacent openings wherein one can covers a plurality of openings.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

The invention claimed is:

1. A chimney flue damper comprising:

a first rigid peripheral frame surrounding an open window area corresponding generally to that of an end of the flue;

a cap for covering said open window area in fixed alignment with said first frame;

a rotatable second frame interposed between said cap and said first frame said rotatable second frame rotating with respect to said first frame and said cap upon opening and closing;

spring means disposed within said first frame, said spring means comprising torsion springs interconnecting said first frame and said second frame rotatably supporting said second frame in a generally horizontal plane relative to said first frame during opening and closing of said damper;

said spring means biasing said cap in a direction away from said first frame to a window open position, said cap being movable toward said first frame against said spring bias to overlie and thereby close said open window areas;

means pivotally interconnecting said cap and said second frame; and means preventing rotation of said cap relative to said first frame when the cap is moved toward and away from said first frame during respectively closing and opening said damper.

2. The flue damper as defined in claim 1 wherein said first frame, in cross-section, has an upwardly directed flange with an inner surface and wherein said spring means lies within an outline bounded by such inner surface.

3. The flue damper as defined in claim 1 wherein said first frame is rectangular in outline shape and wherein said spring mean comprises at least two wire springs each connected at opposite ends thereof respectively to said first and second frames.

4. The flue damper as defined in claim 3 wherein said cap has a downwardly directed peripheral flange aligned to telescopically receive therein said upwardly directed flange on said first frame.

5. The flue damper as defined in claim 1 wherein said means pivotally interconnecting said cap and said second frame includes a pin secured to said cap and projecting downwardly from a lower surface thereof through a centrally disposed hole in said second frame and an anchor block fixedly secured to said pin and disposed below said second frame retaining said second frame on said pin.

6. The flue damper as defined in claim 5 wherein said rotation preventing means comprises linkage means interconnecting said first frame and said anchor block.

7. The flue damper as defined in claim 6 wherein said linkage means comprises a pair of hingedly interconnected members with a first member being pivotally connected to said first frame and the other second member pivotally connected to said anchor block.

8. The flue damper as defined in claim 7 wherein said first member pivotally connecting to said first frame and said second member pivotally connecting to said block rotate on axes parallel to one another.

9. A flue damper comprising:

a first rigid frame having an upwardly directed flange around the periphery of an open window area of a selected size;

cap means of sufficient area as to overlie said upwardly directed flange and the area surrounded by same and in fixed alignment with same;

a rotatable second frame interposed between said cap means and said first frame rotatable with respect to said first frame and said cap means;

spring means disposed within said first frame, said spring means comprising a plurality of torsion springs interconnecting said first frame and said second frame rotatably supporting said second frame said spring means and arrangement thereof being such as to cause said second frame to rotate in a plane essentially parallel to the plane of the window opening as said cap means is moved toward and away from said first frame;

means pivotally mounting said cap means on said second frame; and an articulated link means interconnecting said first frame and said means mounting said cap on said second frame so as prevent the cap from rotating relative to said second frame during opening and closing of the damper.

10. The flue damper as defined in claim 9 wherein said first frame, in cross-section, has an upwardly directed flange with an inner surface and wherein said spring means lies within an outline bounded by such inner surface.

11. The flue damper as defined in claim 9 wherein said first frame is rectangular in outline shape and wherein said spring mean comprises at least two wire springs each connected at opposite ends thereof respectively to said first and second frames.

12. The flue damper as defined in claim 11 wherein said cap has a downwardly directed peripheral flange aligned to telescopically receive therein said upwardly directed flange on said first frame.

13. The flue damper as defined in claim 9 wherein said means pivotally interconnecting said cap and said second frame includes a pin secured to said cap and projecting downwardly from a lower surface thereof through a centrally disposed hole in said second frame and an anchor block fixedly secured to said pin and disposed below said second frame retaining said second frame on said pin.

14. The flue damper as defined in claim 13 wherein said rotation preventing means comprises linkage means interconnecting said first frame and said anchor block.

15. The flue damper as defined in claim 14 wherein said linkage means comprises a pair of hingedly interconnected members with a first member being pivotally connected to said first frame and the other second member pivotally connected to said anchor block.

16. The flue damper as defined in claim 15 wherein said first member pivotally connecting to said first frame and said second member pivotally connecting to said block rotate on axes parallel to one another.

17. The flue damper as defined in claim 1, including a gasket means attaching to said upwardly directed flange for sealing engagement with said cap.

18. The flue damper as defined in claim 9, including a gasket means attaching to said upwardly directed flange for sealing engagement with said cap.

19. The flue damper of claim 1, wherein said torsion springs comprise torsion rod members.

20. The flue damper of claim 9, wherein said torsion springs comprise torsion rod members.

* * * * *